United States Patent [19]

Del Bon

[11] 3,991,916

[45] Nov. 16, 1976

[54] AUTOMATIC CLOSURE DEVICE FOR THE DISCHARGE OF A FOAM PRODUCT FROM A PRESSURIZED CONTAINER

[76] Inventor: Franco Del Bon, 141, Feldstrasse, Ch-4663 Aarburg, Switzerland

[22] Filed: Apr. 11, 1975

[21] Appl. No.: 567,086

[30] Foreign Application Priority Data

| | | |
|---|---|---|
| July 1, 1974 | Switzerland | 9087/74 |
| July 20, 1974 | Switzerland | 10245/74 |
| Aug. 30, 1974 | Switzerland | 11809/74 |

[52] U.S. Cl. ..... 222/402.13; 222/494

[51] Int. Cl.[2] ..... B65D 25/40; B65D 83/14

[58] Field of Search ..... 222/402.13, 402.15, 222/490–497, 528, 529; 137/525.1

[56] References Cited

UNITED STATES PATENTS

| | | | |
|---|---|---|---|
| 1,908,584 | 5/1933 | Weirich | 137/525.1 X |
| 2,755,974 | 7/1956 | Godfrey | 222/496 X |
| 2,913,749 | 11/1959 | Ayres | 222/494 X |
| 3,519,173 | 7/1970 | Sagarin | 222/402.13 |
| 3,642,179 | 2/1972 | Micallef | 222/402.13 X |

*Primary Examiner*—Robert B. Reeves
*Assistant Examiner*—Francis J. Bartuska
*Attorney, Agent, or Firm*—Edwin E. Greigg

[57] ABSTRACT

An automatic closure device for use in combination with a pressurized container which has a liquid or pasty filling dischargeable as a foam, as well as a propellant, and comprises a valve spring-biassed into the closed position is described, which closure device comprises an actuator head having a discharge orifice, a discharge duct in the actuator head which duct connects the discharge orifice with an entry port, remote from the orifice, in the actuator head and serving for connecting the latter to an outlet opening of the container controlled by the aforesaid valve, the discharge duct and orifice being surrounded by an integral wall consisting, at the discharge orifice and the wall portion adjacent the latter, of two wall zones the contact edges of which at the discharge orifice are of equal length and abut each other in closed position while, in open position, these contact edges merge with each other under an acute angle, one of these wall zones being elastically flexible and the other rigid; and a beak-shaped closing member having a lip portion and being associated with the actuator head in a manner such that the free end of the lip portion of the closing member rests against the elastically flexible wall zone from the outside of the latter at the discharge orifice, thus pressing the flexible wall zone in the closed position hermetically sealingly against the rigid wall zone.

18 Claims, 11 Drawing Figures

AUTOMATIC CLOSURE DEVICE FOR THE DISCHARGE OF A FOAM PRODUCT FROM A PRESSURIZED CONTAINER

BRIEF SUMMARY OF THE INVENTION

This closure device is improved in that the discharge duct in the actuator head is provided with an angle or knee zone; the flexible wall zone extends from the discharge orifice rearward at most to the beginning of the knee zone of the duct; and the flexible wall zone is, in the closure position effected by pressure of the free end of the lip portion of the closing member on the outside of the flexible wall zone, inclined relative to the central plane extending through the discharge duct between the flexible and rigid wall zones toward the discharge orifice, at a small angle such that when the spring biassed valve means of the pressurized container suddenly opens, the flexible wall zone will withstand the resulting sudden pressure buildup in the interior of the discharge duct.

BACKGROUND OF THE INVENTION

This invention relates to an automatic closure device for use in combination with a pressurized container which has a liquid or pasty filling dischargeable as a foam, as well as a propellant, preferably a liquified gas and comprises a valve means spring-biassed into the closed position; and which closure device comprises an actuator head having a discharge orifice, a discharge duct in the actuator head which duct connects the discharge orifice with an entry port, remote from the orifice, in the actuator head and serving for connecting the latter to an outlet opening of the container controlled by the aforesaid valve means, the discharge duct and orifice being surrounded by an integral wall consisting, at the discharge orifice and the wall portion adjacent the latter, of two wall zones the contact edges of which at the discharge orifice are of equal length and abut each other in closed position, while, in open position, these contact edges merge with each other under an acute angle, one of these wall zones being elastically flexible and the other rigid; and a beak-shaped closing member having a lip portion and being associated with the actuator head in a manner such that the free end of the lip portion of the closing member rests against the elastically flexible wall zone from the outside of the latter at the discharge orifice, thus pressing the flexible wall zone in the closed position hermetically sealingly the rigid wall zone.

In my Monegasque U.S. Pat. No. 105874.983, issued May 7, 1974, which corresponds to U.S. Pat. Nos. 3,858,773 and 3,937,371, there is described a closure head of the type described above and serving for the automatic discharge of paste when compressing a collapsible tube equipped therewith. The embodiment illustrated in FIGS. 29 to 31 of the drawings of this patent is adapted for use with pressurized containers, however, manufacturing this known embodiment of a closure device from synthetic thermoplastic material by modern injection molding techniques is only possible in a complicated manner, requiring molds which are difficult to make and several production steps. Moreover it is necessary to fill the wide outlet channel 303 up to the discharge mouth 304 under the full internal propellant pressure prevailing in the pressure container, before the flexible wall zone 306 will be lifted off from the rigid wall zone 305, thereby deflecting the beak part 307 serving as a closing member and opening the discharge mouth 304 in the form of an arc (FIG. 30 of the Monegasque patent).

Those known closure devices for discharging foam which are presently on the market, for instance dispensers for shaving cream have a main drawback. After each dispensing, a residue of foam remains in and at the discharge mouth in contact with the surrounding air, and will dry, age and become decomposed by the influence of the oxygen in the air and by bacteria growing in the residue. When such a foam-dispensing pressurized container is used again after prolonged standing, it is unavoidable that a portion of the old decomposed foam residue infested with bacteria will first be brought onto the skin of the face or other parts of the user's body and will then be covered with fresh foam dispensed from the interior of the pressurized container, leading to infection of the skin.

Likewise, with most of the known containers, closing of the discharge valve of the latter will still permit an excess of foam to emerge from the discharge orifice and stick to the outside wall of the container (after-foaming). In order to overcome this drawback, British Pat. No. 1,365,472 describes an aerosol closure cap in which the residual foam emerging due to after-foaming is trapped in a reservoir provided in the interior of the closure cap. However, the drying and aging foam in the reservior remains in contact with the outside air and is likable to be contaminated by bacteria, and the amount of foam thus decomposing in the reservoir increases with each dispensing operation. Furthermore, the reservoir must be rather large to be big enough to accommodate the whole amount of foam due to after-foaming.

It is, therefore, an object of the invention to provide an automatic closure device of the type initially described having practically no after-foaming.

It is another object of the invention to provide an automatic closure device of the type initially described the operation of which is practically free from after-foaming and which permits a hygienically unobjectionable closing of the closure device on the pressure container.

These objects are attained and the drawbacks of the prior art are avoided by a closure device as initially described which is improved by having the discharge duct in the actuator head provided with a bend or knee zone and by having the flexible wall zone extend from the discharge orifice rearward at most to the beginning of the bended zone of the duct and by having the flexible wall zone, in the closure position effected by pressure of the free end of the lip portion of the closing member on the outside of the flexible wall zone, inclined relative to the central plane extending through the discharge duct between the flexible and rigid wall zones toward the discharge orifice, at a sufficiently small angle, so that when the spring biassed valve means of the pressurized container suddenly opens, the flexible wall zone will withstand the resulting sudden pressure buildup in the interior of the discharge duct.

In this improved closure device according to the invention, the actuator head is preferably surrounded by a cap, which is mounted on the pressurized container and has an opening at the top or on the side thereof accessible to manipulation and further has a lateral cut-out in which the portion of the actuator head containing the discharge orifice is lodged.

Furthermore, the portion of the actuator head which contains the discharge orifice is displaceable within the cap along the central axis of the pressurized container which axis extends through the valve thereof when the actuator head and the valve to which it is connected are depressed in the direction toward the interior of the pressurized container, whereby the said valve is opened. The return movement of the actuator head relative to the cap can be effected by the same spring which biasses the valve of the pressurized container into its closing position.

Preferably, the cross-sectional area of the discharge duct, at the discharge orifice and in the region of the duct extending to the bend thereof is, at maximum opening, at least equal to the cross-sectional area of the discharge duct at where the last-mentioned region merges with the knee zone.

More preferably, the region of the discharge duct extending from the bend to the discharge orifice is of constant cross-sectional area when the discharge orifice is maximally opened. The region of the discharge duct extending from the bend therein to the entry port is preferably also of a constant cross-sectional area.

It is particularly advantageous when in the closure device according to the invention, the part of the inner wall of the discharge duct constituted by the rigid wall zone is of concave cross-section at least at the rim of the discharge orifice and relative to the central duct axis through the orifice, and the free end of the lip portion of the closing member is of correspondingly convex shape whereby, in the closed position, the flexible wall portion is correspondingly convexly deformed and pressed with a hermetic seal onto the rigid wall zone.

According to a first preferred embodiment of the closure device according to the invention, the closing member is made integral with the top front wall of the cap and the spring-biased valve of the pressurized container acts in such a manner on the actuator head in the direction of the longitudinal axis of the region of the discharge duct extending from the bend in the latter to the entry port that the rigid wall zone and the flexible wall zone are pressed against one another and against the free end of the lip portion of the closing member, thereby hermetically sealing the discharge orifice. In this embodiment the actuator head is preferably slidingly guided in the interior of the cap and a movable member of the spring-biassed valve of the pressurized container can then be positively connected to the actuator head at the entry port of the latter, whereby, in the closed position, the actuator head is so displaced in the interior of the cap in the direction toward the top front wall of the latter, that the rigid wall zone of the discharge duct is pressed with hermetic seal against the flexible wall zone which in turn is at all times in contact with the free end of the lip portion of the closing member.

In this embodiment, the cap member is preferably provided with an outlet opening in which the discharge orifice of the actuator head is lodged, and the lip portion of the closing member extends adjacent the flexible wall zone to contact with its free end the rim of the flexible wall zone at the discharge orifice. The cap is then preferably provided with a rigid top frontal wall about an opening through which the actuator head is accessible, and the lateral outlet opening of the cap is located at at level below the lip portion, whereby the elastic wall zone in the actuator head always rests on the downwardly facing free end of the lip portion in the lateral outlet opening. The top frontal wall of the cap preferably has a recess in its periphery away from the lip portion through which recess the surface of the actuator head is accessible for displacement of the latter in a direction out of the cap. Preferably, this recess in the top frontal wall of the cap is located on the side of the actuator head approximately opposite the side thereof containing the entry port.

It is of particular advantage when the central axis of the region of the discharge duct extending from the bend therein to the entry port coincides with the central axis of the cap and the displacement of the actuator head relative to the cap when opening or closing the discharge orifice, takes place along this common axis.

Furthermore, arresting means can be provided whereby the cap and the actuator head can be locked together with the discharge orifice closed.

Moreover, a male connecting member can be provided to protrude inwardly from the inner face of the top frontal wall of the cap and a female connecting part can be provided on the outer face of the actuator head next adjacent the flexible wall zone, and facing away from the entry port, or the female connecting member is provided at the cap and the male member is provided on the outer face of the actuator head, whereby the male and female connecting members can be engaged as in a press button and whereby upon engagement of the two connecting members with one another the flexible wall zone and the lip portion are given a bias toward hermetically sealingly pressing on the rigid wall zone.

The top frontal wall of the cap can be provided with an opening extending through the male connecting member protruding from the inside of that wall, through the opening of which the outer face of the actuator head is accessible for actuation.

Advantageously the male connecting member consists of a sleeve bearing on its outside from its free end a radially outwardly protruding flange or bead, and the female connecting member can consist of a recess in the outer face of the actuator head turned away from the entry port which recess is provided with a radially inwardly extending flange or bead about the outer periphery of the recess, thus permitting snap engagement of the two members.

According to the closure device according to the invention, the actuator head is provided in its top end wall, which latter can be reached for actuation through an opening in the cap, with a recess the bottom of which is constituted by the outside surface of the flexible wall zone of the discharge duct, and, as an extension of the said recess, a cavity is provided in the end wall of the recess located toward the center of the top end wall, and the closing member comprises a deflectable arm the free end of which is biassed to press against the flexible wall zone at the discharge orifice, and a lever part connected to the opposite end of the said arm which lever part is inserted in the said cavity. The bias of the deflectable arm is such that the arm will yield at a determined increase of pressure in the discharge duct, whereby the flexible wall zone can be moved away from the rigid wall zone and the discharge orifice can be open as long as the increased pressure prevails in the duct.

Further objects of the invention will become apparent from the subsequent description thereof in connection with the drawings which illustrate non-limitative embodiments of the closure device according to the invention.

DETAILED DESCRIPTION OF THE EMBODIMENTS

Figure 2:
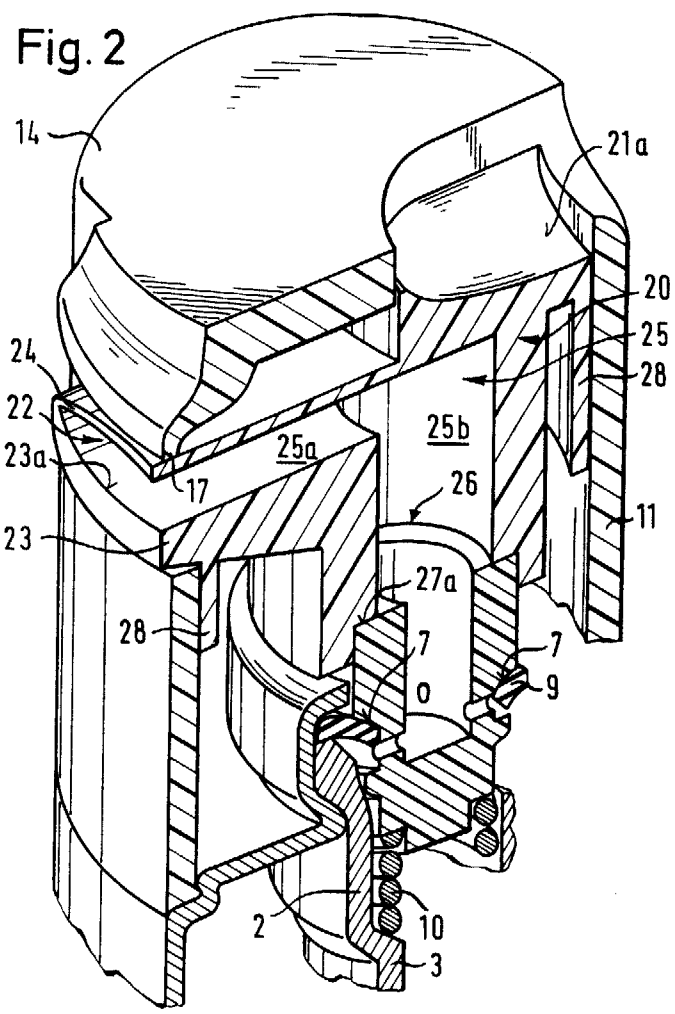
FIG. 2 shows the same view and cut of the first embodiment, however in actuated position.
Figure 1:
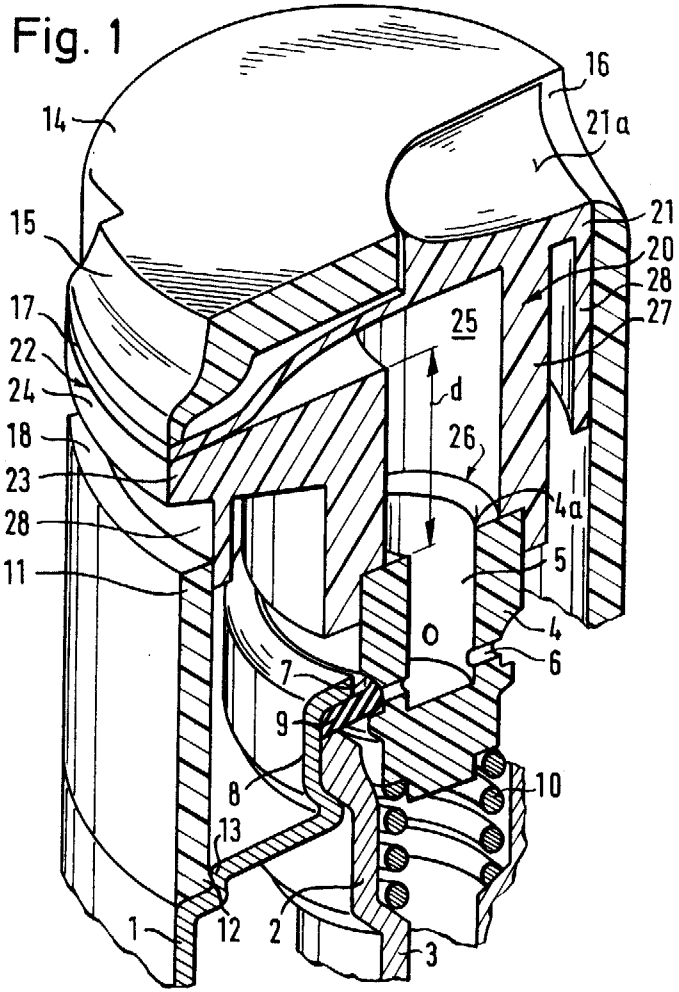
FIG. 1 is a perspective and longitudinal view of a first embodiment of the automatic closure device according to the invention in closed position.
Figure 3:
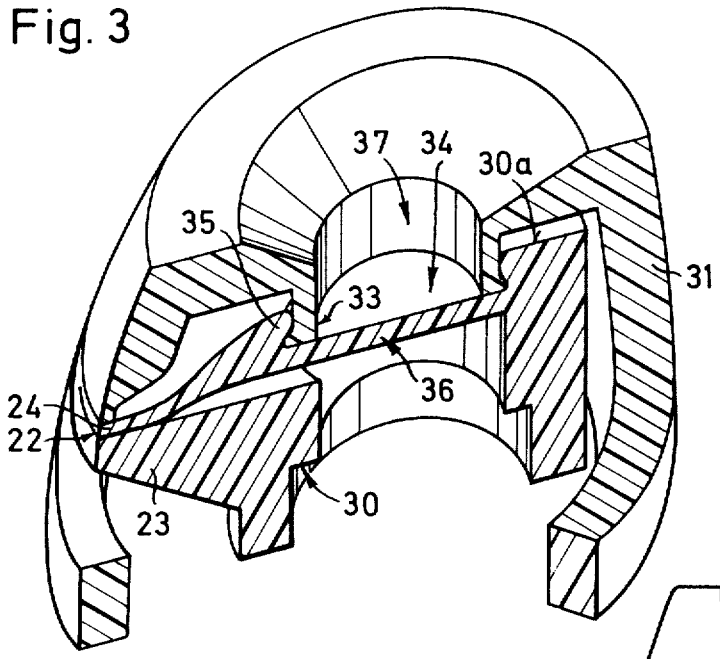
FIG. 3 is a perspective and longitudinal view of a second embodiment in closed position.

The embodiment of the closure device according to the invention shown in FIGS. 1 and 2 is mounted preferably permanently on a pressurized container 1 of conventional design which is equipped with a valve comprising a valve housing 2, a suction tube 3 immersed in a liquid or foam-forming product filled in the container and being under the pressure of a propellant such as, for instance, Freon 12 with an addition of Freon 11, or carbon dioxide, or propane, butane or nitrogen suboxide or the like, a movable valve member or stem 4 having a central passage 5 therethrough and radial ducts 6 which open into an annular groove 7 about the stem 4, an annular sealing gasket 9 fixed at its outer periphery between the upper end rim of the valve housing 2 and a top or lid part 8 of the container 1, and a return spring 10 urging the valve stem 4 into the closed position shown in FIG. 1.

This embodiment further comprises a cap 11 which bears a top frontal wall 14 comprising a lip portion 15 and a window 16 in a part of the top frontal wall 15 away from lip portion 14, as well as an outlet opening 18 in the lateral, preferably cylindrical wall of cap 11 beneath the lip portion 15 which latter has a convexly shaped rim 17 at its free end. Cap 11 bears at the periphery of its open end a internal bead 12 which is firmly snap-connected in a corresponding outwardly protruding bead 13 of the lid part 8 of the pressurized container 1.

Of course, the fastening of cap 11 on pressurized container 1 must be so strong that it will resist the outwardly directed pressure of return spring 10 and also an eventually occuring additional pressure of the sealing gasket 9 against the upwardly directed side wall of the annular groove 7. However, this stress or separating force exerted on the connection between cap 11 and container 1 is only relatively small.

In the interior of cap 11 there is housed an actuator head 20 which is displaceable in the direction of the central longitudinal cap axis inside cap 11. An actuating nose 21 of actuator head 20 extends into window 16 of cap 11 and it is preferred that the top end surface 21*a* of nose 21 is flush with the top frontal wall 14 of cap 11. Furthermore, actuator head 20 comprises the discharge orifice 22 which is formed between the concavely shaped inner rim 23*a* of a rigid wall zone 23 and an elastically flexible wall zone 24, both being integral parts of actuator head 20. The flexible wall zone 24 is squeezed with hermetic seal between the rigid wall zone 23 and the correspondingly convexly shaped free end rim 17 of lip portion 15 when the device is in closed position, i.e. discharge orifice 22 is closed.

As shown in FIG. 2, the flexible wall zone 24 is also convexly shaped in open position. In that position the discharge orifice 22 has a lentil-shaped cross-section which is preferably also maintained in the part 25*a* of discharge duct 25 extending backwardly from the discharge orifice 22 into the actuator head 20, whereas the part 25*b* of discharge duct 25 extending at an angle to part 25*a* towards the entry port 26 of the actuator head is preferably of circular cross-section.

While manufacturing the actuator head from synthetic resin material by injection molding it is thus possible to introduce in a very simple manner a core of lentil-shaped cross-section into the injection mold from the side of the discharge orifice 22 and a cylindrically-shaped core with a correspondingly concave top surface from the side of entry port 26.

The smallest distance d between, on the one hand, the edge of flexible wall zone 24 at the orifice, when this wall zone rests on the free end 17 of lip 15, and, on the other hand, the recessed annular shoulder 27*a* of the sleeve 27 about entry port 26 of actuator head 20, which shoulder 27*a* rests on the external frontal face 4*a* of valve stem 4, is preferably so dimensioned that the valve stem 4 is slightly depressed inwardly, i.e. toward the interior of container 1, against the pressure of spring 10 and, optionally, against the pressure of the slightly outwardly vaulted sealing gasket 9, when cap 11 is mounted on container 1, whereby the radial ducts 6 in valve stem 4 must remain hermetically sealed by the annular gasket 9. This guarantees that the elastic wall zone 24 is lightly pressed at the orifice 22 against the free lip end 17 and also against the rigid wall zone 23, these parts being in the closed position shown in FIG. 1.

In order to guide the actuator head 20 securely in the cap 11, a guiding sleeve 28 is provided dependent from the upper portion of actuator head and being slidably displaceable without sealing on the internal wall of cap 11.

An undesired opening of the closure device according to the invention can be prevented by bolting means provided in the window 16 of actuator head 20, being for instance a small bolt (not shown) retractably protruding into the actuating nose 21.

The closure device according to the invention is opened (FIG. 2) by exerting pressure with a finger on the top end surface 21*a* on nose 21 of the actuator head 20. Thereby, the valve stem 4 is moved into the valve housing 2 against the pressure of spring 10 and, optionally, against that of annular gasket 9, thus initially balancing the slight abutting pressure of the rigid wall zone 23 against the flexible wall zone 24 and of the latter against the free lip end 17. Upon further depression of actuator head 20, the tapered side wall of annular groove 7 of valve stem 4 deflects the inner rim about the central opening of annular gasket 9 downwardly (i.e. toward the interior of container 1) whereby the radial ducts 6 open out of stem 4 above annular gasket 9 and product from container 1, being under the pressure of a propellant therein, can enter the branch 25*b* of discharge duct 25 of the actuator head 20 via riser tube 3, radial ducts 6 and central valve stem passage 5.

At the same time, the downward movement of actuator head 20 with the exception of the elastic wall zone 24 which remains in contact with the central portion of free lip end 17 owing to a bias imparted to this wall zone during its manufacture and causing it to adopt a concave outward bulging as shown in FIG. 2, this discharge orifice 22 opens and is retained in its opened position (showing a lentil-shaped cross-sectional area) due to the pressure of the mixture of product and propellant being discharged, even when the pressure of the finger on actuating surface 21*a* decreases slightly.

When pressure of the finger on nose surface 21*a* ceases, return spring 10 will urge the valve stem 4 outwardly (i.e. upwardly in FIG. 2) and the inner rim of annular gasket 9 will snap into its slightly outwardly deflected position in which the gasket closes the radial ducts 6 and supports the action of spring 10 of raising the rigid wall zone 23, thereby causing the flexible wall zone 24 to snap into sealing abutment on the concave inner rim 23*a* of rigid wall zone 23 at the discharge orifice 22, and, at the same time, into sealing abutment on the convex rim of free lip end 17 of lip portion 15.

As the annular sealing gasket 9 will close radial ducts 6 before the final closing position shown in FIG. 1, is reached there will remain practically no more excess pressure in discharge duct 25 when discharge orifice 22 is closed; and a very small excess pressure of spring 10, optionally supported by that of annular gasket 9 on the tapered side wall of groove 7 of valve stem 4 and thereby on the external frontal face 4*a* of the latter against the shoulder 27*a* in sleeve 27 will suffice for achieving a hermetic closure of discharge orifice 22 of discharge duct 25, whereby foamy product filling the latter duct but not being under excess pressure will be satisfactorily protected from contact with the ambient air and thus against drying out and decomposition.

It has been found in practice that the sealing effect between shoulder 27*a* of actuator head sleeve 27 and the external frontal face 4*a* of valve stem 4, when these two surfaces fit smoothly one against the other, is fully satisfactory to prevent leaking therefrom of the mixture of product and propellant during or after a discharge.

Figure 4:
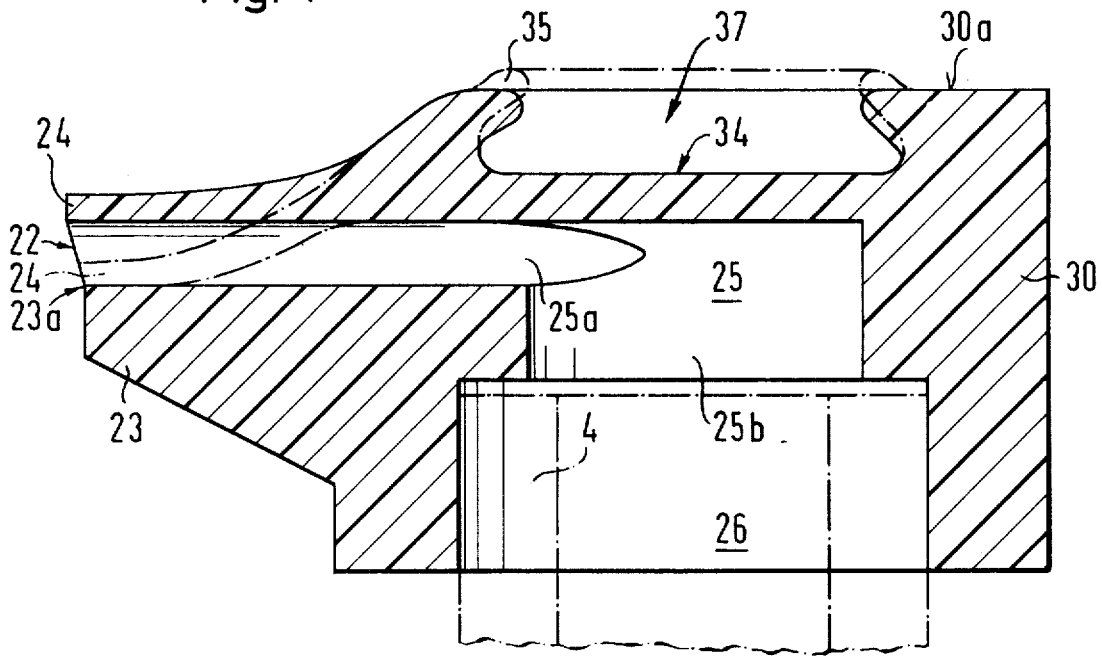
FIG. 4 is a longitudinal view through an actuator head of the embodiment according to FIG. 3, but not fit into the cap portion, and the fixed position by dotted lines.
Figure 5:
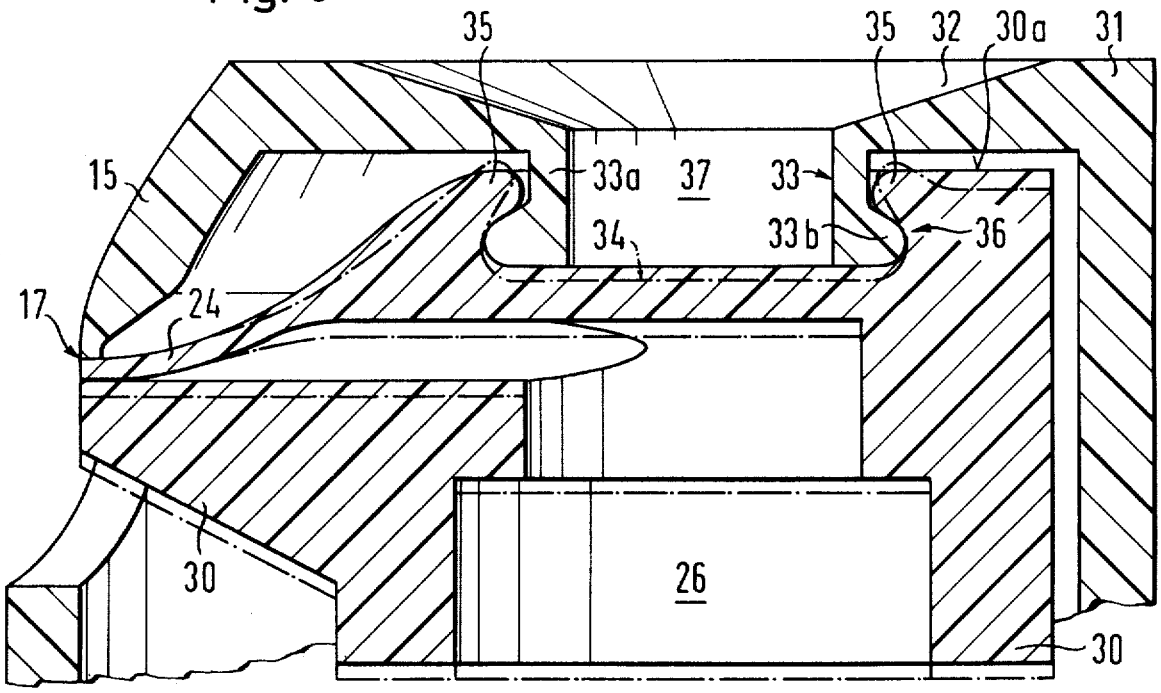
FIG. 5 is a longitudinal view through the actuator head fixed to the cap portion in closed and dotted in open position.
Figure 8:
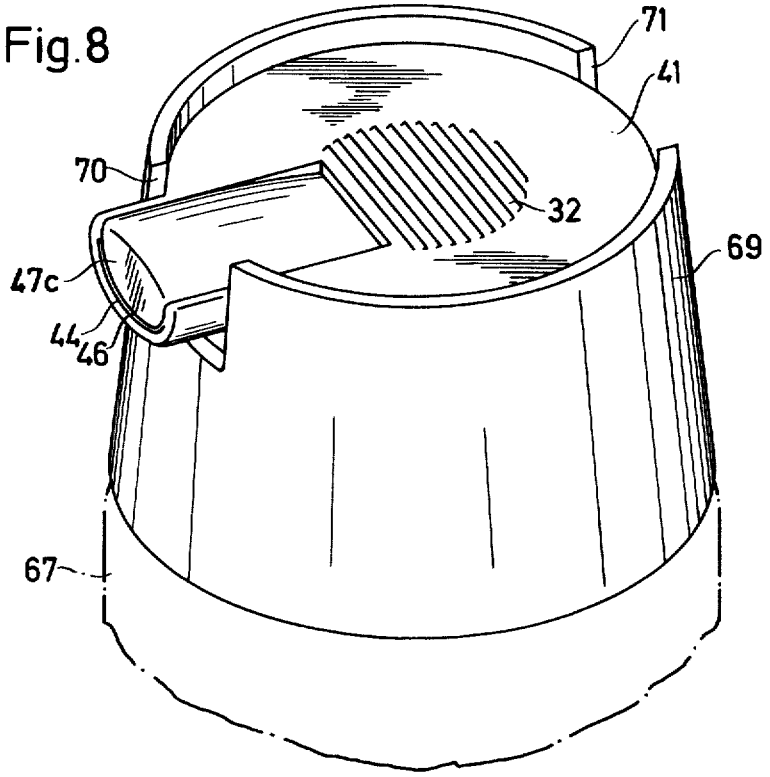
FIG. 8 is a perspective view of a preferred embodiment of the closure device according to the invention with closed orifice.

In the embodiment shown in FIGS. 3 to 6, the beak-shaped closing member acts on a flexible wall zone 24, closing bias being provided by pressure-button type connecting means between the actuator head 30 and a closing cap 31, such bias replacing the spring action of spring 10 of the outlet valve of container 1 used in the preceding embodiment. The pressure button type connecting means consist of:

1. a male member 33 comprising a tubular socket 33*a* protruding on the inside of frontal end valve 32 of the closing cap 31, and having at its free edge a radially outwardly extending annular flange or bead 33*b*, and 2. a female member 36 integral with actuator head 30 and comprising a circular recess 34 in the upper frontal face 30*a* of the actuator head 30 and, about the recess 34 at the outer rim thereof, a relatively flexible, radially inwardly extending annular bead or flange 35 (FIGS. 4 and 5).

In its frontal end wall 32 the closing cap 31 has an actuating finger opening 37 which is preferably disposed centrally to the longitudinal axis of the movable valve stem 4 of the outlet valve of the pressure container (not shown). Through this opening 37, the bottom face of circular recess 34 can be depressed by a finger of the user, whereby the closure device will be caused to open in a manner described further below.

All other parts of the actuator head 30 and the closing cap 31 are practically identical with the corresponding parts of actuator head 20 and cap 11 and are designated by the same numerals as in the first embodiment.

Figure 7:
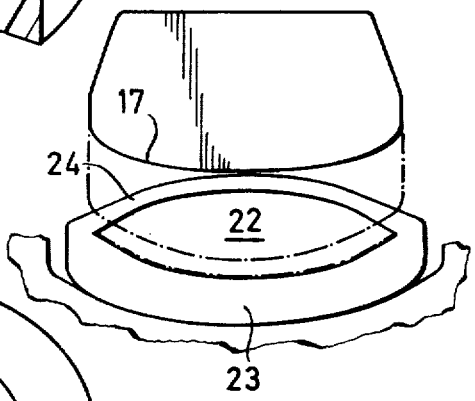
FIG. 7 is a frontal view of the orifice zone of the embodiment in open position according to FIG. 6 and dotted in closed position according to FIG. 3.
Figure 6:
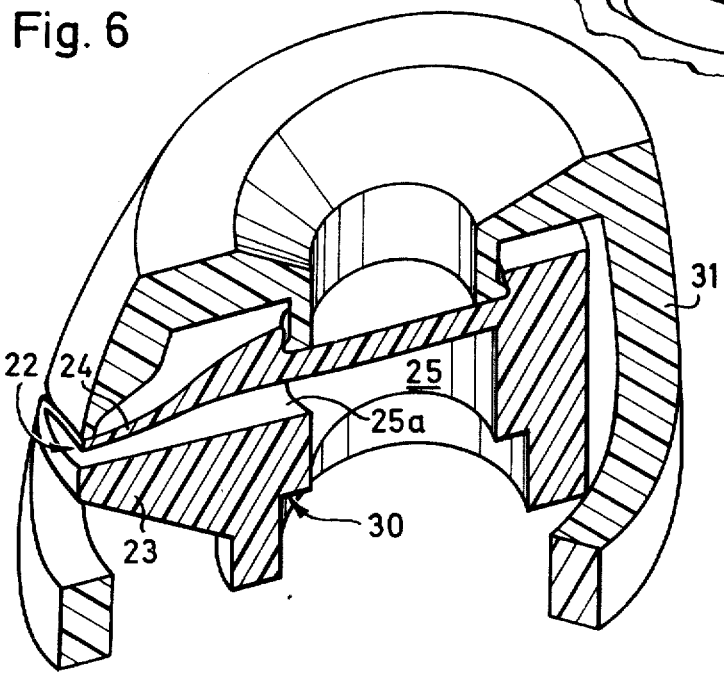
FIG. 6 shows the embodiment represented in FIG. 3 in opened position.

In FIG. 4, the actuator head 30 is shown prior to its insertion into the closing cap 31. The actuator heads 20 and 30 are preferably manufactured by injection molding techniques from thermoplastic synthetic resin materials and especially from high-pressure polyethylene, e.g. Lupolene 1800S made by BASF, Ludwigshafen, Germany. Caps 11 and 31 are preferably made from low-pressure polyethylene, e.g. 5011K or 6011L also made by BASF. In the actuator head 30 as produced by injection molding the discharge orifice 22 of discharge duct 25 is initially wide open and the elastically flexible wall zone 24 is then preferably unbiassed. The cross-section of the fully opened orifice is shown in FIG. 7.

During insertion of the actuator head 30 into the closing cap 31 the flexible wall portion 24 is deflected under pressure into the position marked by dotted lines in FIG. 4, thereby closing the orifice 22. This assembly is shown in FIG. 5. Hereby, the actuator head 30 with male member 33 is pressed in the same manner as a male pressure button part into engagement with the female member 36, toward the interior of the closing cap 31, whereby the relatively flexible annular, radially inwardly extending bead 35 grips behind the radially outwardly extending flange 33b. After this snap-in engagement of the actuator head 30 with the closing cap 31, the lip portion 15 of the latter presses the elastic wall zone 24 hermetically sealingly against the rigid wall zone 23.

This embodiment of the closure device according to the invention is actuated by applying pressure through the opening 37 onto the bottom surface of the circular recess 34 and thereby pressing the whole actuator head 30 downwardly by a short distance, for instance by 1 to 2 mm. Thereby, the actuator head 30 is moved into the discharge position marked by dotted lines in FIG. 5 and shown perspectively in FIG. 6, in which position the breadth of opening of the orifice 22 equals the distance by which the actuator head 30 was pressed downwards out of its initial snap-in position according to FIG. 5. However the elastic wall zone 24 does not follow the downward movement of the remainder of actuator head 30, because in the zone of the orifice 22 it lies against the frontal side of the lip portion 15 and is already in the closed position, under pressure, thus having a tendency to return as far as possible to its unbiassed position according to FIG. 4. Consequently, the relatively flexible, annular radially inwardly extending bead 35 is slightly downwardly displaced on the outwardly vaulted surface of the radially outwardly extending flange or bead 33*b*, and thereby spread apart under a tension, which causes it to pull the actuator head 30 upward again, when the pressure on the bottom surface of the recess 34 ceases, thereby returning to its position to total snap-in shown in FIG. 5 and thereby pressing the rigid wall portion 27 with renewed hermetical sealing of the orifice 22 against the flexible wall portion 24 resting on the frontal surface of the lip portion 15.

Details about data of the physical forces involved and about the dimensions of such a snap-in-connection can be found for instance in Publication No. 3101.1. of BASF, 'Kunststoffe in der Konstruktion — Schnappverbindungen' published in May 1973.

As shown in this publication, the tubular socket 33*a* with flange 33*b* can also be divided into resilient segments by longitudinal cuts.

The embodiment of the invention shown in FIGS. 8 to 11 comprises a cap top wall 41 with a sleeve 42 surrounding the entry port 42*a*, in which the discharge duct 43 extends through a first vertical region 43*a* to the angular region 43*b* and hence through the horizontal region 43*c* to the discharge orifice 44.

Figure 9:
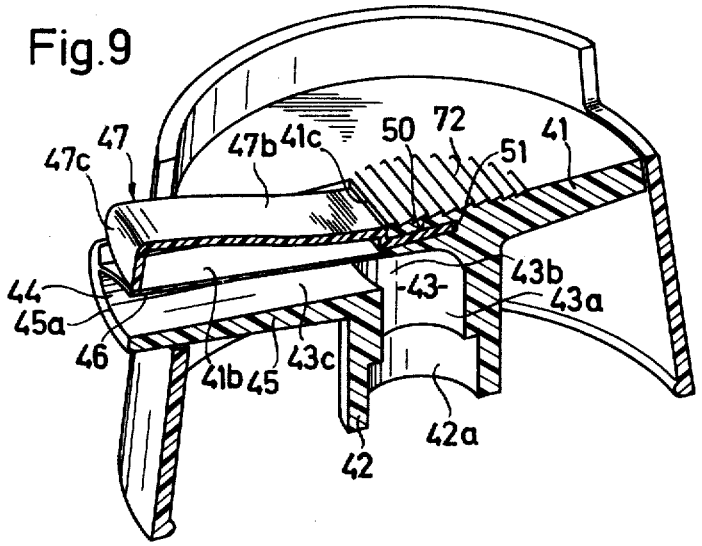
FIG. 9 is a perspective view of the same closure device but cut along the longitudinal axis of the discharge duct and with open orifice.

As shown in FIG. 9, the duct region 43*a* has a circular-shaped and the region 43*c* a lentil-shaped, uniform cross-sectional area. Thus, in the production of the cap top wall 41 by injection molding techniques, the removal of the core poses no problems.

The part of the duct region 43*c* lying towards the orifice 44 is surrounded by an uninterrupted wall 45 forming a part of the cap top wall 41, which contains at its top, i.e. on its side remote from the pressure container, a flexible wall zone 46 whereas the remaining wall portion of wall 45 is rigid.

In the rear part of wall 45, towards the angular region 43*b*, the upper side of wall 45 is also rigid and has a cut-out 41b in its surface, the bottom of which is formed by the elastically flexible wall zone 46.

On the side 41*c* of the recess 41*b*, looking away from the orifice 44, a cavity 50 is provided in the rigid wall part above the discharge duct 43, into which cavity the end 51, turned away from the orifice 44 of beak member 47, is seated in a tight fit. The part of beak member 47 which protrudes out of cavity 50 constitutes an elastic, spring-biassed arm 47*b* which rests with the lip 47*c* located on its free end against the elastically flexible wall 46. An especially tight-sealing closure of the orifice 44 is achieved by shaping the orifice edge 45*a* of the rigid part of the wall 45 concavely relative to the central axis of duct 43 and the corresponding contact edge of the lip 47*c* correspondingly convex, as well as by making the contact edge of the elastically flexible wall 46 and the rigid orifice edge 45*a*, which edges come into contact with each other when the orifice 44 is closed, of equal length. The two edges intersect with one another at an angle of about 45° taken in the orifice plane, which angle is defined by the tangents of the wall zone rims through the vertex of the angle.

The wall 42 around the entry port 42*a* is tightly and sealingly connected to the movable valve stem 65 of the outlet valve 66 of a pressure container 67. On the outer rim 68 of the pressure container 67, an annular protective shield 69 is mounted, for instance by crimping 69*a*. Inside this protective shield 69 the correspondingly shaped cap top wall 41 is guided during actuation. Shield 69 has a window 70 through which the wall 45 surrounding the orifice 44 protrudes. On the opposite side a cutout can be provided in the rim of the shield 69 to serve for the actuating finger of the hand of a user holding the pressure container.

Figure 10:
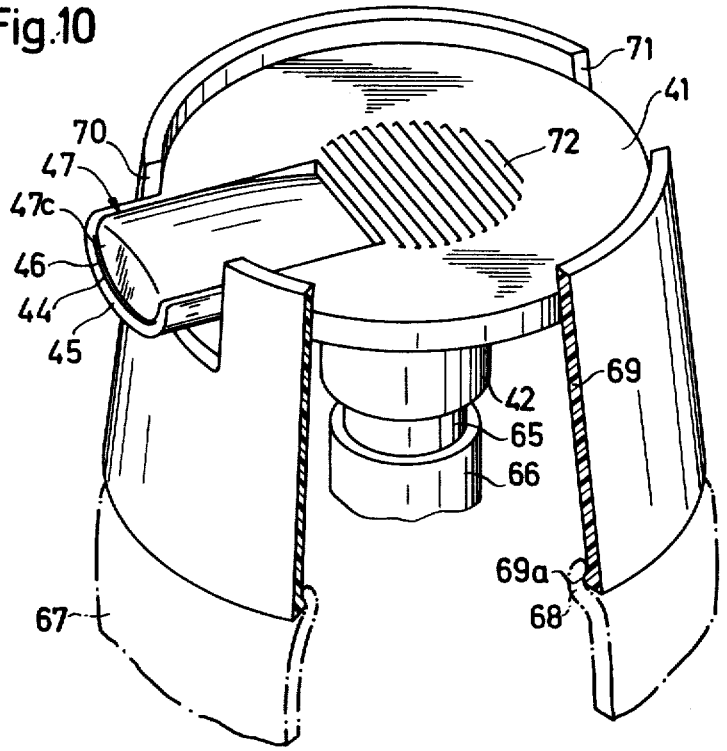
FIG. 10 is a perspective view of the closure device similar to that shown in FIG. 9 but with cut open guide shield, mounted on a pressurized container.
Figure 11:
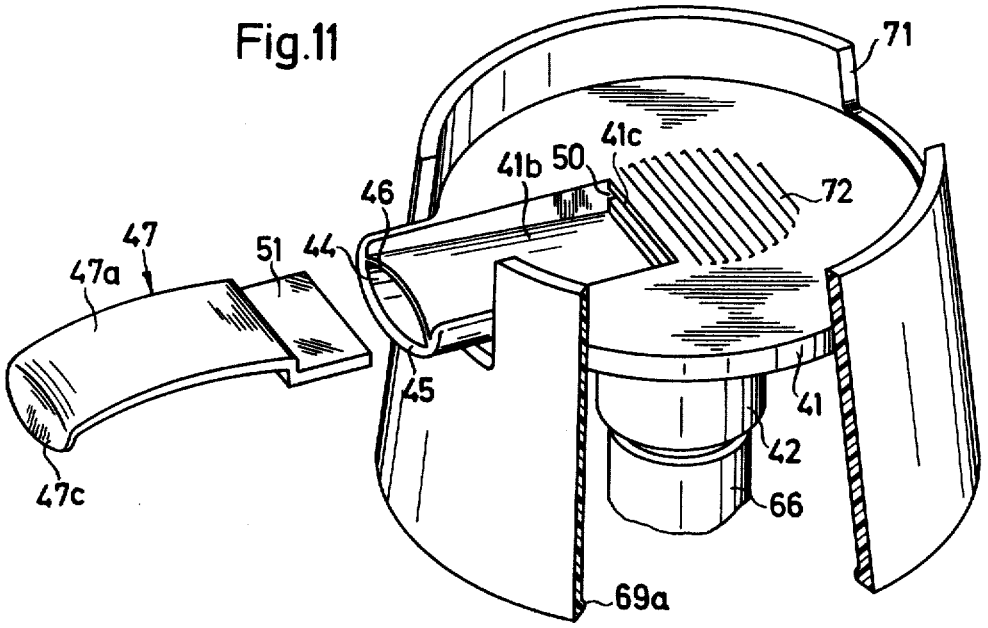
FIG. 11 shows the same view as FIG. 10 but with removed closure member.

The user can actuate the closure device by pressing on the upper frontal wall 72 of the cap top wall 41 with the tip of the finger lying in recess 71, thereby the outlet valve of the pressure container 67 is depressed and thus moved out of the closed position shown in FIG. 10 into the discharge position of FIG. 11.

Thereby the product, preferably in form of a foam or optionally of a paste, is expelled by the pressure in container 67 into the discharge duct 43. On penetrating into the region 43*c* of the latter duct, the product, assisted optionally by a portion of propellant discharged ahead of it, raises the elastically flexible wall zone 46, so that the contact edge of this zone lifts off from the orifice edge 45*a* of the rigid wall zone while simultaneously lifting the lip 47*c* and tensioning the elastically flexible arm 47*b* of the beak member 47, whereby the flexible wall zone 46 snaps out of the convex contact position along the rigid contact edge 45*a* into its opposite, concave position. With a correspondingly chosen material, e.g. polyethylene, no upsetting deformation of the elastically flexible zone edge occurs during the transition but rather an S-shaped deformation as a transitional stage to the concave position.

As soon as the finger of the user releases the cap top wall 41, the latter returns under the pressure of a return spring member (not shown) always provided in the valve of the pressure container out of the open position of FIG. 11 back into the closed position of FIG. 10. Thereby, the excess pressure prevailing in the discharge duct 43 drops immediately, and the lip 47*c* of the arm 47*b* of the beak member 47 presses the elastically flexible wall zone 46 at the orifice 44 again out of its concave shape back into its convex contact shape into position on the rigid wall portion edge 45*a*. Thus, the orifice 44 is again hermetically sealed, and the remaining product in the discharge duct 43 is protected securely against the influence of the ambient air.

What is claimed is:

1. An automatic closure device for use in combination with a pressurized container which has a liquid or pasty filling dischargeable as a form, as well as a propellant, and comprises a valve means spring-biassed into the closed position; which closure device comprises an actuator head having a discharge orifice, a single discharge duct in the actuator head which duct connects the discharge orifice with an entry port, remote from the orifice, in the actuator head and serving for connecting the latter to an outlet opening of the container controlled by the aforesaid valve means, the discharge duct and orifice being surrounded by an integral wall consisting, at the discharge orifice and the wall portion adjacent the latter, of two wall zones the contact edges of which at the discharge orifice are of equal length and abut each other in closed position while, in open position, these contact edges merge with each other under an acute angle, one of these wall zones being elastically flexible and the other rigid; and a beak-shaped closing member having a lip portion and being associated with the actuator head in a manner such that the free end of the lip portion of the closing member rests against the elastically flexible wall zone from the outside of the latter at the discharge orifice, thus pressing the flexible wall zone in the closed position hermetically sealingly against the rigid wall zone; said discharge duct in said actuator head being provided with a bend or knee zone; said flexible wall extending from the discharge orifice rearward at most to the beginning of the knee zone of the duct; and said flexible wall zone being, in the closure position effected by pressure of the free end of the lip portion of the closing member on the outside of the flexible wall zone, inclined relative to the central plane extending through the discharge duct between the flexible and rigid wall zones toward the discharge orifice, at a small angle such that when the spring biassed valve means of the pressurized container suddenly opens, the flexible wall zone will withstand the resulting sudden pressure buildup in the interior of the discharge duct; a cap, mounted on the pressurized container and surrounding said actuator head, having an opening therein to permit access to, and manipulation of said actuator head; wherein the portion of the actuator head which contains the discharge orifice is displaceable within said cap along the central axis of the pressurized container which axis extends through the valve thereof; and a spring for effecting the return movement of the actuator head relative to the cap, said spring being adapted for biassing the valve of the pressurized container into its closing position, and said spring acting in such a manner on the actuator head in the direction of the longitudinal axis of the region of the discharge duct extending from the knee zone in the latter to the entry port that the rigid wall zone and the flexible wall zone are pressed against one another and against the free end of the lip portion of said closing member, thereby hermetically sealing the discharge orifice.

2. A closure device as described in claim 1, wherein said cap has a lateral cut-out in which the portion of the actuator head containing the discharge orifice is lodged.

3. A closure device as described in claim 1, wherein the cross-sectional area of the discharge duct, at the discharge orifice and in the region of the duct extending to the knee zone thereof is, at maximum opening, at least equal to the cross-sectional area of the discharge duct as where the last-mentioned region merges with the knee zone.

4. A closure device as described in claim 1, wherein the region of the discharge duct extending from the knee zone to the discharge orifice is of constant cross-sectional area when the discharge orifice is maximally opened.

5. A closure device as described in claim 4, wherein the region of the discharge duct extending from the knee zone therein to the entry port is a constant cross-sectional area.

6. A closure device as described in claim 1, wherein the part of the inner wall of the discharge duct constituted by the rigid wall zone is of concave cross-section at least at the rim of said discharge orifice and relative to the central duct axis through the orifice, and the free end of the lip portion of said closing member is of correspondingly convex shape whereby, in the closed position, the flexible wall portion is correspondingly convexly deformed and pressed with a hermetic seal onto the rigid wall zone.

7. A closure device as described in claim 1, wherein said closing member is made integral with the top front wall of said cap.

8. A closure device as described in claim 7, wherein said actuator head is slidingly guided in the interior of said cap and which comprises further a movable member being part of the spring-biassed valve of the pressurized container, said movable member being positively connected to said actuator head at the entry port of the latter, whereby, in the closed position, the actuator head is so displaced in the interior of the cap in the direction toward the top front wall of the latter, that the rigid wall zone of the discharge duct is pressed with hermetic seal against the flexible wall zone which in turn is at all times in contact with the free end of the lip portion of the closing member.

9. A closure device as described in claim 2, wherein said cap is provided with an outlet opening in which the discharge orifice of said actuator head is lodged, and the lip portion of said closing member extends adjacent the flexible wall zone to contact with its free end the rim of the flexible wall zone at the discharge orifice.

10. A closure device as described in claim 9, wherein said cap is provided with a rigid top frontal wall surrounding an opening through which said actuator head is accessible, and said lateral outlet opening of said cap is then located at a level below said lip portion, whereby the elastic wall zone in said actuator head always rests on the downwardly facing free end of said lip portion in the lateral outlet opening.

11. A closure device as described in claim 10, wherein said top frontal wall of said cap has a recess in its periphery away from the lip portion through which recess the surface of said actuator head is accessible for displacement of the latter in a direction out of said cap.

12. A closure device as described in claim 11, wherein the recess in the top frontal wall of said cap is located on the side of said actuator head approximately opposite the side thereof containing the entry port.

13. A closure device as described in claim 12, wherein the central axis of the region of the discharge duct extending from the knee zone therein to the entry port coincides with the central axis of said cap, and the displacement of said actuator head relative to said cap, when opening or closing the discharge orifice, takes place along this common axis.

14. A closure device as described in claim 2, further comprising a male connecting member adapted to protrude inwardly from the inner face of the top frontal wall of said cap, and a female connecting part on the outer face of said actuator head next adjacent the flexible wall zone, and facing away from the entry port; or said female connecting member being provided at said cap and said male member being provided on the outer face of said actuator head; whereby said male and female connecting members can be engaged, as in a press button, and whereby upon engagement of the two connecting members with one another the flexible wall zone and the lip portion are given a bias toward hermetically sealingly pressing on the rigid wall zone.

15. A closure device as described in claim 14, wherein the top frontal wall of said cap has an opening extending through said male connecting member protruding from the inside of that wall, through the opening of which the outer face of said actuator head is accessible for actuation.

16. A closure device as described in claim 14, wherein said male connecting member consists of a sleeve bearing on its outside about its free end a radially outwardly protruding flange, and said female connecting member consists of a recess in the outer face of said actuator head turned away from the entry port which recess is provided with a radially inwardly extending flange or bead about the outer periphery of the recess, thus permitting snap engagemet of the two members.

17. A closure device as described in claim 1, wherein said actuator head has in its top end wall, which latter can be reached for actuation through an opening in said cap, a recess the bottom of which is constituted by the outside surface of the flexible wall zone of the discharge duct, and, as an extension of the said recess, a cavity being in the end wall of the recess located toward the center of the top end wall, and said closing member comprises a deflectable arm the free end of which is biassed to press against the flexible wall zone at the discharge orifice, and a lever part connected to the opposite end of the said arm which lever part is inserted in said cavity.

18. A closure device as described in claim 17, wherein the bias of said deflectable arm is such that the arm will yield at a determined increase of pressure in the discharge duct, whereby the flexible wall zone is moved away from the rigid wall zone and the discharge orifice remains open as long as the increased pressure prevails in the duct.

* * * * *